United States Patent [19]

Dickerson

[11] 4,098,235

[45] Jul. 4, 1978

[54] FUEL FEED CONTROL APPARATUS AND SYSTEM

[75] Inventor: Alan William Dickerson, Melbourne, Australia

[73] Assignee: Repco Research Proprietary Limited, Dandenong, Australia

[21] Appl. No.: 607,260

[22] Filed: Aug. 25, 1975

[30] Foreign Application Priority Data

Aug. 28, 1974 [AU] Australia ..... PB8680
Aug. 28, 1974 [AU] Australia ..... PB8681

[51] Int. Cl.[2] ..... F02M 51/00
[52] U.S. Cl. ..... 123/32 EG; 123/32 EJ
[58] Field of Search ... 123/32 EA, 140 CC, 140 MC, 123/179 L, 32 EG, 32 EJ, 32 AE; 261/44 R

[56] References Cited

U.S. PATENT DOCUMENTS

| | | | |
|---|---|---|---|
| 3,210,055 | 10/1965 | Kingsley | 261/39 B |
| 3,543,739 | 12/1970 | Mennesson | 123/32 EA |
| 3,608,533 | 9/1971 | Mennesson | 123/32 EA |
| 3,664,319 | 5/1972 | Channing | 123/140 MC |
| 3,712,275 | 1/1973 | Jackson | 123/32 EA |
| 3,714,934 | 2/1973 | Mennesson | 123/140 MC |
| 3,885,004 | 5/1975 | Marsee | 261/44 R X |

FOREIGN PATENT DOCUMENTS 1,302,536 7/1902 France.

*Primary Examiner*—Charles J. Myhre
*Assistant Examiner*—Tony M. Argenbright
*Attorney, Agent, or Firm*—Lerner, David, Littenberg & Samuel

[57] ABSTRACT

A fuel injection control apparatus of the kind in which an auxiliary throttle air flow monitor responds to flow of air through an air passage, and by that response influences switching means for the injectors such that the injector on-time is determined by the flow monitor. It is a feature of the apparatus that a control element is arranged to intrude into the air passage to form a restriction to flow of air and thereby influence the flow monitor position, and to also provide a stop which is engageable by the flow monitor to determine a minimum flow position of that monitor. The control element position is regulated by a device which responds to changes in engine temperature so that the control element intrusion is at a maximum under cold conditions and is at a minimum or is non-existent at normal operating temperature of the engine.

17 Claims, 19 Drawing Figures

FUEL FEED CONTROL APPARATUS AND SYSTEM

The invention relates to fuel feed control apparatus for fuel injection systems such as used with spark ignition internal combustion engines, and particularly such fuel injection systems in which the intake of air is metered to control the proportioning of injected fuel to air consumed. The apparatus of the invention is especially concerned with causing fuel enrichment under cold starting and other operating conditions of an engine. The invention further relates to a control system incorporating such apparatus, for controlling the ratio of fuel injected to air consumed.

One known method of determining air consumption rate of an engine is to employ an air valve or variable venturi device of similar construction to that commonly used in variable venturi carburettors. Such device is characterized by an opening, through which the air passes, having a cross-sectional area which is directly related to air flow through the device at a given time. To effect this relationship, a variable element of the device moves relative to a datum position and this movement provides a measure of the air consumption rate to the engine.

The movement of the variable element may be employed as in the manner proposed in U.S. Pat. No. 3,543,739, or as in the Bosch L. jetronic type ECGI-system, to provide an analogue electrical signal to an electrical computing means coupled to the fuel injection system.

The movement of the variable element in response to air flow normally is used in conjunction with other elements of a fuel injection system to maintain a substantially constant ratio between fuel injected and air consumed. However, under cold engine start and running conditions it is necessary to increase temporarily the ratio of fuel injected to air consumed. It also is necessary to allow extra air to enter the engine under cold idling conditions and this commonly is effected by means of a bimetallic type thermostat to advance a throttle idle stop under cold conditions.

Still further, during normal running (i.e., the engine at its normal operating temperature) the fuel to air ratio at air consumption ratio corresponding to light and medium throttle openings is controlled by fuel economy and exhaust emission considerations, and is leaner than the ratio required for maximum power generation at a particular engine speed. It is therefore desirable to provide means whereby the fuel to air ratio is increased at maximum opening of the throttle.

Yet another occasion requiring fuel enrichment, is when the throttle is suddenly opened as distinct from the progressive opening occuring during a normal progressive increase of engine power. That requirement is particularly pronounced in vehicle engines, as there are occasions on which rapid acceleration is required, and with prior control systems it is found that there is a delay in the system response to the new throttle position such as to provide the necessary fuel to air ratio.

It is an object of the present invention to provide improved apparatus for temporarily increasing the ratio of fuel injected to air consumed under cold engine start and running conditions and/or for allowing extra air to enter the engine under cold idling.

It is another object of the invention to provide a fuel feed control system incorporating apparatus as referred to above. Still another object of the invention in a preferred form, is to provide such a system in which fuel enrichment occurs at maximum opening of the throttle. Yet another object of the invention in a preferred form, is to provide such a system in which fuel enrichment occurs temporarily in response to sudden opening of the throttle.

According to one aspect of the invention, there is provided fuel feed control apparatus for internal combustion engine fuel injection systems, including: an air duct connectable into the air induction system of an engine; an air flow monitor connected to said duct and being movable relative thereto in response to flow of air through said duct, and being connectable to switching means for at least one injector of said injection system so as to determine the on time of the injector according to the position of said monitor relative to said duct; a control element operable to intrude into said duct to form a restriction to flow of air through said duct and to also provide a variable position stop which is operable to determine a minimum flow position of said monitor; and temperature responsive means connected to said control element to cause said operation thereof, and being connectable to the engine so as to respond to the temperature thereof and thereby vary said control element intrusion.

According to another aspect of the invention, there is provided a control system for internal combustion engine fuel injection systems, including: an air supply passage connectable to at least one cylinder of the engine and the outlet of the fuel injector associated with said cylinder; a throttle valve operable to restrict the flow of air through said passage and being adjustable to vary the degree of that restriction; injector switching means operable to cause intermittent actuation of said injector and to determine the period of time over which each said actuation extends; an air flow monitor connected to said passage on the air inlet side of said throttle valve and being movable in response to flow of air through the passage; means connecting said flow monitor and said switching means whereby said period of time is varied according to the flow of air through said passage; a monitor control element operable to intrude into said flow passage to form a secondary flow restrictor and to also provide a variable position stop which is operable to determine a minimum flow position of said flow monitor; and temperature responsive means connected to said control element so as to cause said operation thereof, and being arranged to vary the degree of said intrusion according to the temperature of said engine.

The following description refers in more detail to these essential features and further optional features of the invention. To facilitate an understanding of the invention, reference is made to the accompanying drawings where these features are illustrated in preferred form. It is to be understood however, that the essential and optional features of the invention are not limited to the specific forms of these features as shown in the drawings.

In the drawings:

FIG. 6(*b*) is a view similar to FIG. 6(*a*), but showing the relative positions of components in the cold idling condition, and also showing in broken line the relative positions of those components during cold running of the engine;

Figure 18:
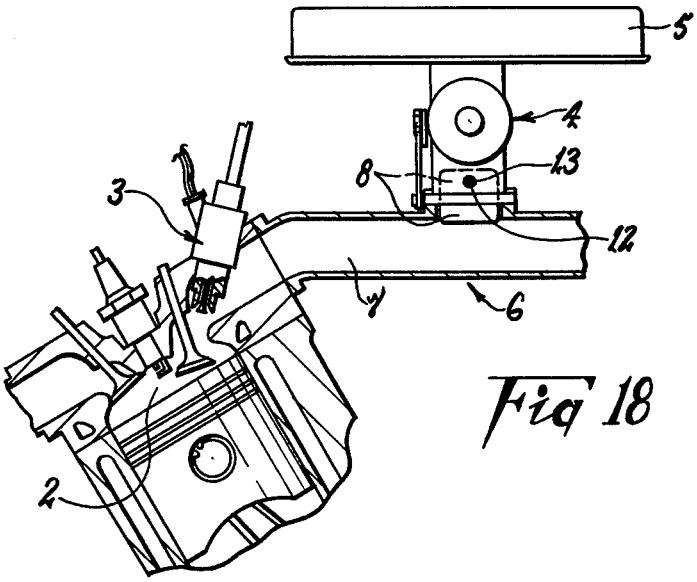
FIG. 18 is a diagrammatic view of a typical control system as applied to an internal combustion engine and incorporating apparatus according to the invention.

As mentioned above FIG. 18 shows in diagrammatic form a fuel feed control system according to the invention as applied to a typical internal combustion engine arrangement. The main application of the invention is in relation to vehicle engines, in which case there will normally be a plurality of cylinders 2 and a corresponding number of solenoid type fuel injectors 3. FIG. 18 however, shows a single cylinder 2 and related injector 3 for convenience of illustration. The apparatus of the invention is generally represented by numeral 4 in FIG. 18, and is connected into the air induction system of the ingine between the air cleaner 5 and the inlet manifold 6. Only one complete passage 7 of the manifold 6 is shown. The throttle valve 8 which functions in a known manner as a flow restrictor, is shown as included in the body of the apparatus 4, but it may be connected to a part of the manifold 6 if desired. A linkage system of known form connects the valve 8 to the vehicle accelerator (not shown) to permit the valve position to be adjusted and thereby vary the degree of restriction it provides within the air flow passage.

Reference will now be made to FIGS. 1 to 4 of the drawings which illustrate a particular embodiment of the apparatus 4. The apparatus 4 includes a duct or air passage extension 9, which may be of any appropriate cross-sectional shape — e.g., square or rectangular — and is connectable into the air induction system of an engine as shown in FIG. 18. Air passes through duct 9 in the direction shown by the arrow in FIG. 2, and the throttle valve 8 is located at the outlet end of the duct 9. A tubular connector 11 permits connection of the interior of the duct 9 with the engine crank case (not shown) for the purpose of removal of crank case fumes, and a heater tube 12 is secured to a tubular connector 13 for a purpose hereinafter described.

Figure 2:
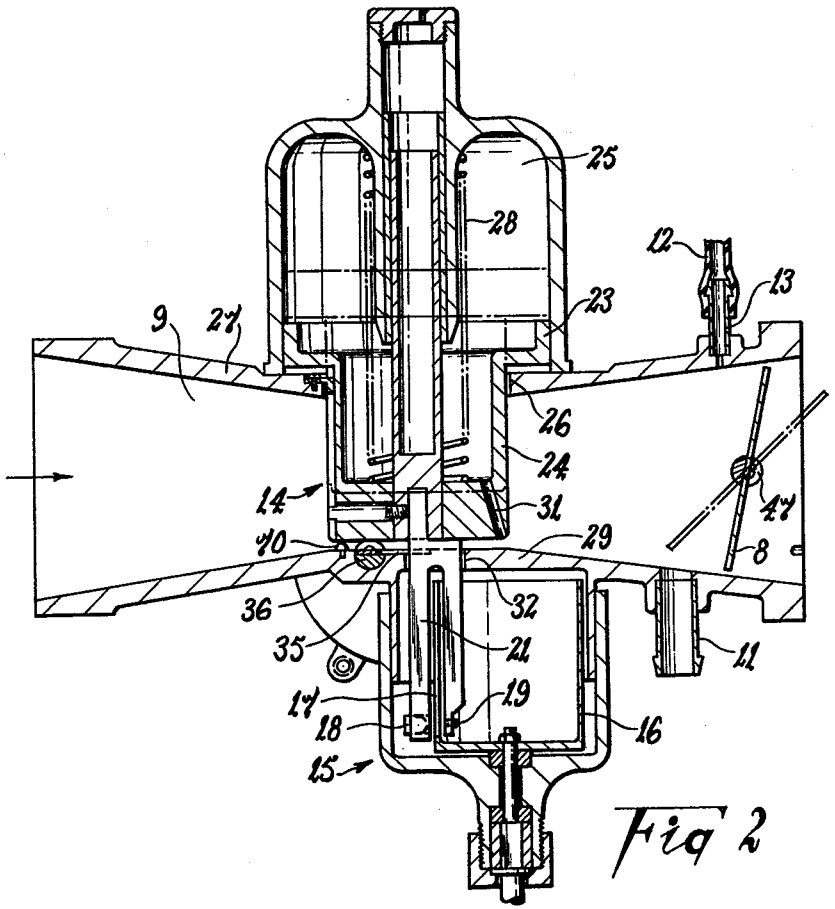
FIG. 2 is a cross-sectional view taken along line II—II of FIG. 1.
Figure 1:
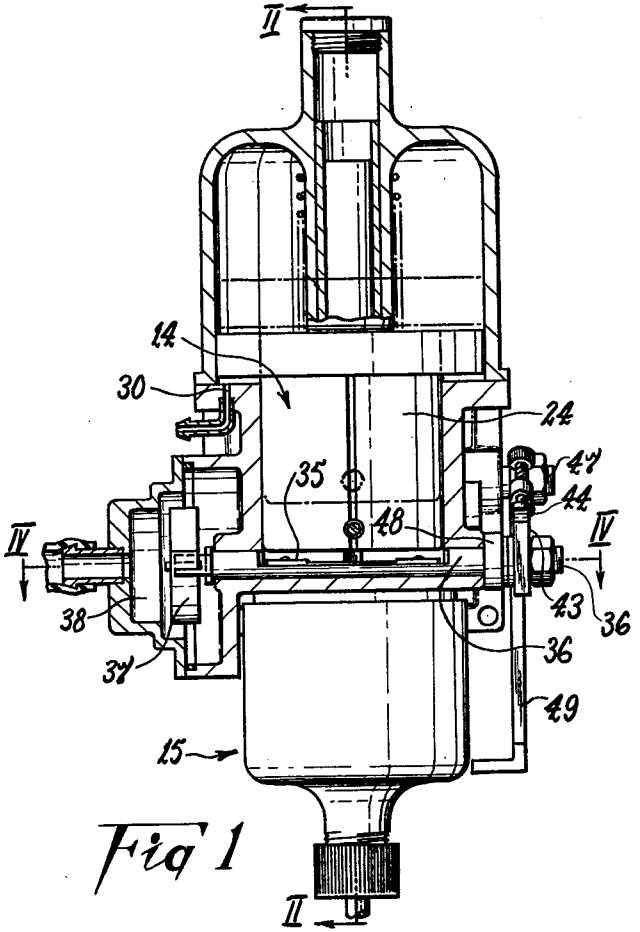
FIG. 1 is a cross-sectional view of one embodiment of apparatus in accordance with the invention, and in which the condition of the apparatus is that existing during idling of the associated engine at normal running temperatures.
Figure 5:
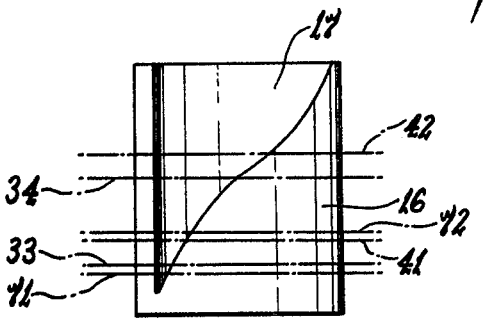
FIG. 5 is an enlarged side elevational view of the rotatable switching cup as used in the apparatus of FIG. 1.
Figure 10:
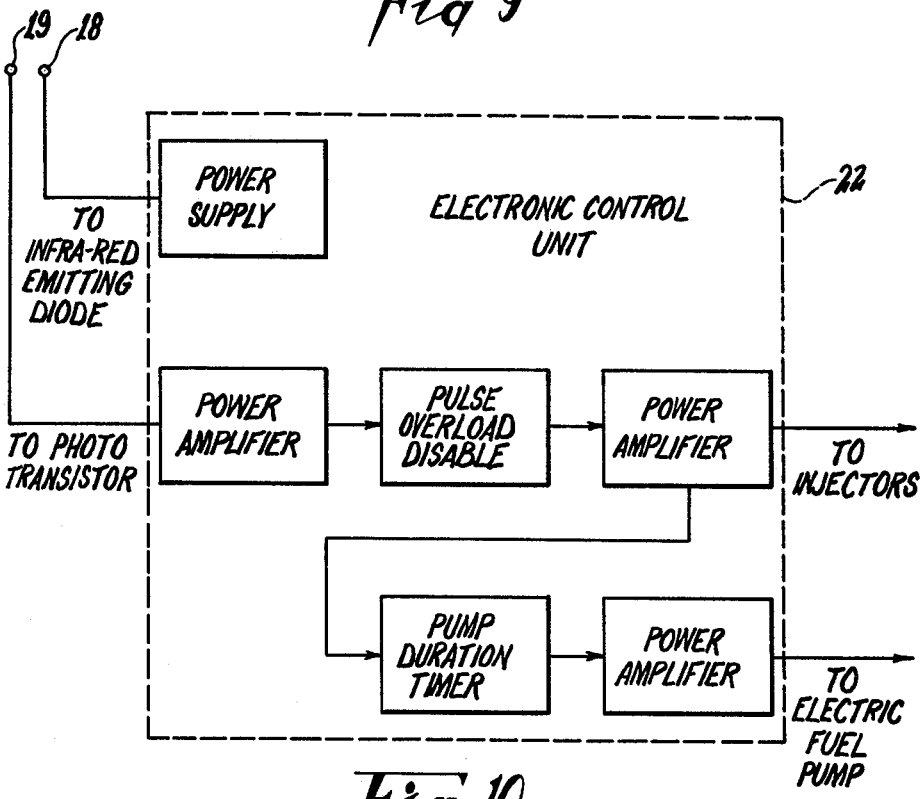
FIG. 10 is a block diagram of the electronic circuitry of switching means usable with the apparatus of the invention.
Figures 11, 12, 13, 14:
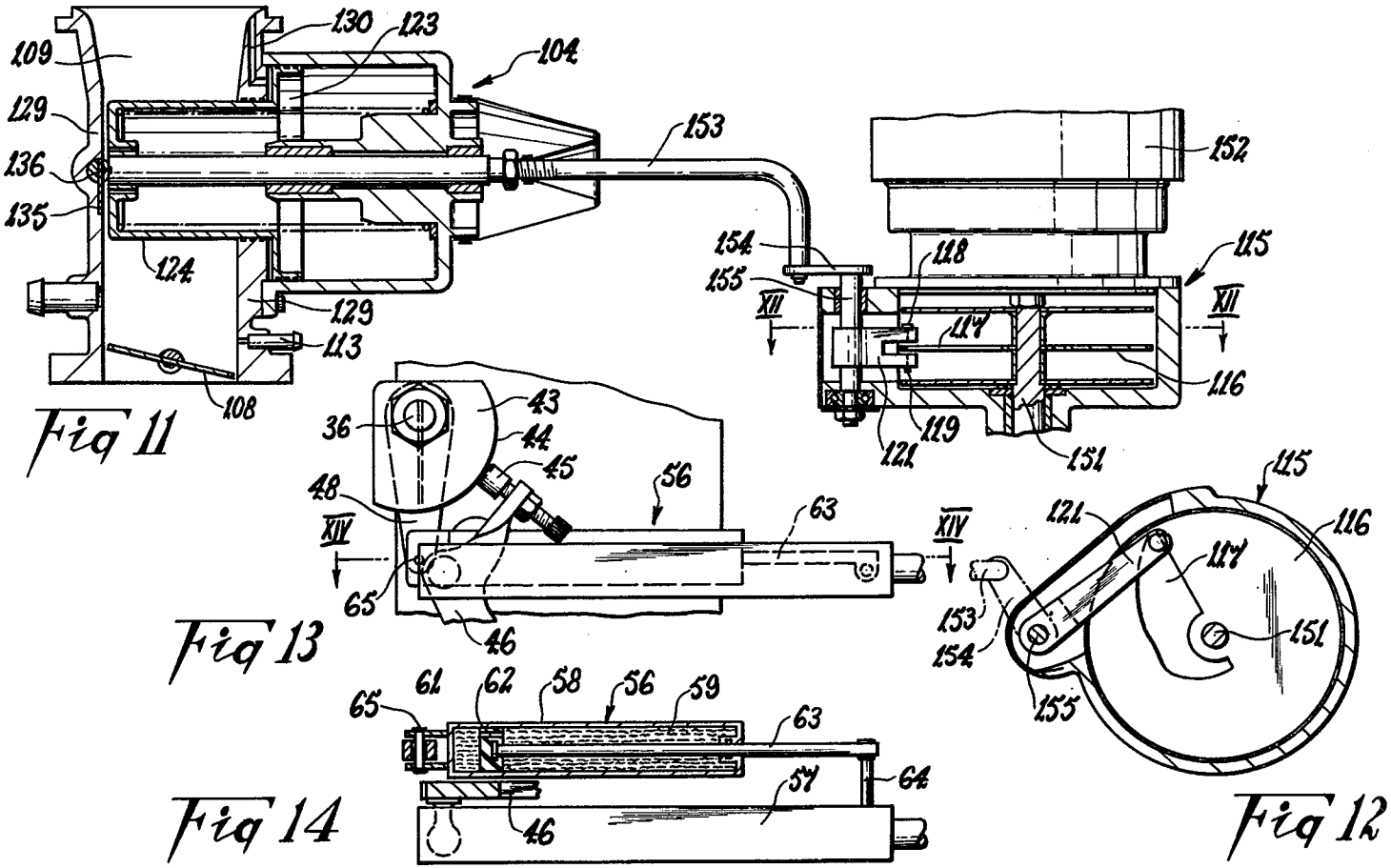
FIG. 11 is a cross-sectional view of an alternative form of the apparatus, shown in the same operative condition as FIG. 2.
FIG. 12 is a cross-sectional view taken along line XII—XII of FIG. 11.
FIG. 13 is an elevational view of part of the apparatus showing a modification involving a coupling with the throttle linkage system, and which modification is applicable to either the embodiments of FIGS. 1 or 11.
FIG. 14 is a sectional view taken along line XIV—XIV of FIG. 13.

A movable flow monitor 14 is connected into the duct 9 so as to move in response to flow of air therethrough, and is connected to injector switching means 15. The switching means 15 is of known construction and operation (see for example U.S. Pat. No. 3,543,739) and may be connected direct to the duct 9 as shown in FIGS. 1 and 2, or it may be located remote therefrom as shown in FIG. 11. In the FIG. 1 construction, the switching means 15 comprises a rotatable cup 16 having a slit 17 of varying width (see FIG. 5) formed therein, and a light source 18 and detector 19 mounted on a carrier 21 in opposed spaced relationship and located on opposite sides respectively of the cup wall containing the slit 17. It is usually preferred to use an infra-red emitting diode as the light source 18 and a photo-transistor functions as the detector 19. Those components are connected into an electronic control unit as shown diagrammatically in FIG. 10, and the construction and operation of that unit is well known and will not be described in detail in this specification.

The flow monitor 14 of the construction shown is in the form of a piston 23 having an extension 24 which projects into the duct 9. It will be appreciated however, that other forms of flow monitors may be used, and it is not essential for the monitor to intrude into the duct 9, although better results are usually obtained if that is the case. The piston 23 is slidable within a chamber 25, and the extension 24 passes through an opening 26 in a wall 27 of the duct 9. The piston extension 24 is urged by a spring 28 towards the opposite wall 29 of the duct 9. A passage 31 in the piston extension 24 provides a communication between the duct 9 and the chamber 25 for a purpose hereinafter made clear. Positive pressure, from a suitable reference point, is fed to the underside of the piston 23 in the chamber 25, and in the FIG. 1 construction that is achieved through a passage 30 which may be connected to the engine side of the air cleaner through a conduit (not shown). The carrier 21 which supports the switching elements 18 and 19, is secured to the piston extension 24 so as to move therewith and passes freely through an opening 32 in the duct wall 29.

In operation of the components so far described, flow of air through the duct 9 is controlled by the valve 8, and when that valve is opened to permit flow in the direction of the arrow shown in FIG. 2, a venturi effect is created by the restricted opening between the piston extension 24 and the duct wall 29. As a result, a negative pressure is created in the chamber 25 through the communication passage 31, and the magnitude of that negative pressure will increase as the flow velocity past the end of the passage 31 increases. Because of that effect, a pressure differential is created between the duct 9 and the chamber 25 so that the piston 23 is caused to move further into the chamber 25, as shown for example by the broken line in FIGS. 1 and 2. As a result of that movement, the switching elements 18 and 19 are moved further along the rotatable cup 16 so that their axis of communication is moved from the position shown in line 33 of FIG. 5 to the position shown by line 34. Thus, the exposure time of those elements through the slit 17 is greater at the new position, and consequently the "on-time" of the injectors 3 is also greater. In that respect the operation is substantially as described in U.S. Pat. No. 3,543,739.

The correct signal duration (i.e., injector on-time) for engine starting at or near normal operating temperature, is preferably controlled by a stop member 70 as shown in FIG. 2. That stop 70 results in an opening for air being left beneath the piston extension 24, and the size of that opening can be determined according to requirements. It will be appreciated that the same effect might be achieved by other means such as by limiting the length of the extension 24 of provision of a suitable stop beneath the piston 23. When the piston extension bottoms on the stop 70, the axis of communication between the switching elements 18 and 19 is as shown by line 71 of FIG. 5.

Figure 4:
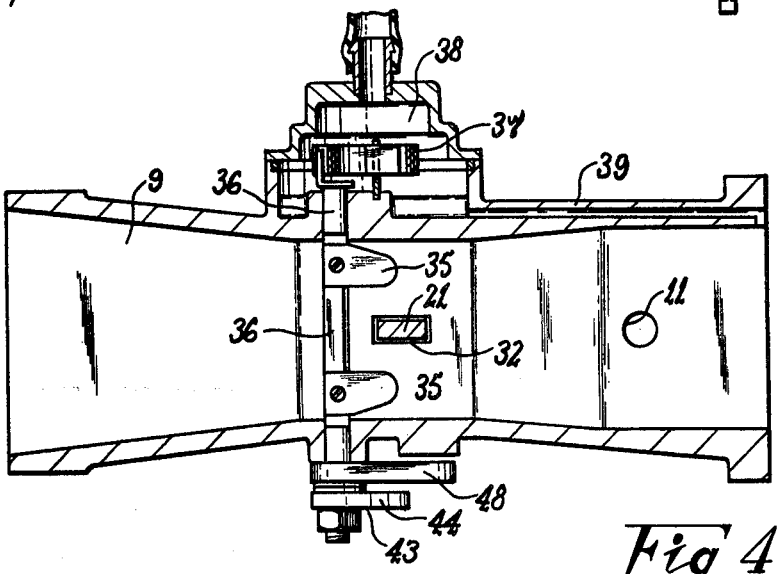
FIG. 4 is a cross-sectional view taken along line IV—IV of FIG. 1.

It is a feature of the present invention that a control element is provided to function both as a secondary flow restrictor in the duct 9, and as a minimum flow position stop for the monitor 14. In the embodiment shown, that control element comprises two plate-like members 35 secured to a rotatable shaft 36 in laterally spaced relationship, as shown in FIG. 4. The shaft 36 is rotatably mounted on the duct 9, and as shown in FIG. 2 can adopt a rotational position in which the plates 35 do not intrude into the duct 9. The space between the plates 35 provides a passage for the switching element carrier 21 as particularly shown in FIG. 4.

A temperature responsive device, which in the construction shown is a bi-metal coil 37, is connected between one end of the shaft 36 and a suitable support so as to control rotation of the shaft 36. The coil 37 is arranged to respond to changes in engine temperature and cause appropriate positioning of the control plates 35 as hereinafter described. In the arrangement shown, such temperature sensing is achieved by containing the coil 37 in a compartment 38 which is connected through the tube 12 to the duct 9. The tube 12 is arranged so as to be subjected to the exhaust gases of the engine so that the temperature of the air in the tube 12, and consequently the coil compartment 38, varies in accordance with the engine temperature. A return air passage 39 redirects air from the compartment 38 into the duct 9 as shown in FIG. 4.

Figure 6A:
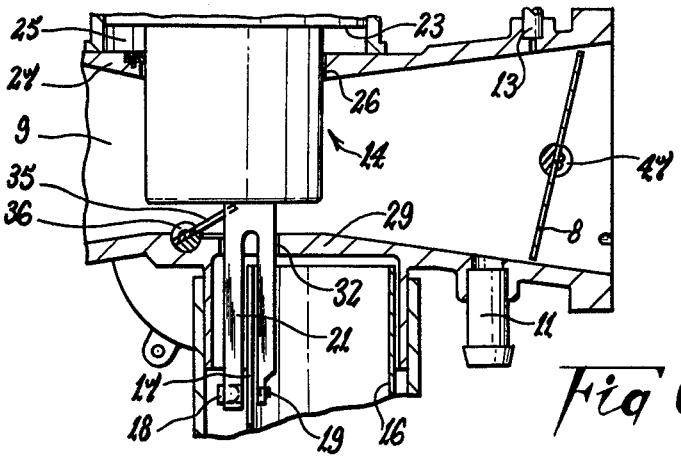
FIG. 6(*a*) is a view similar to FIG. 3 but showing part only of the apparatus and showing the relative positions of components in a cold starting situation.
Figure 6B:
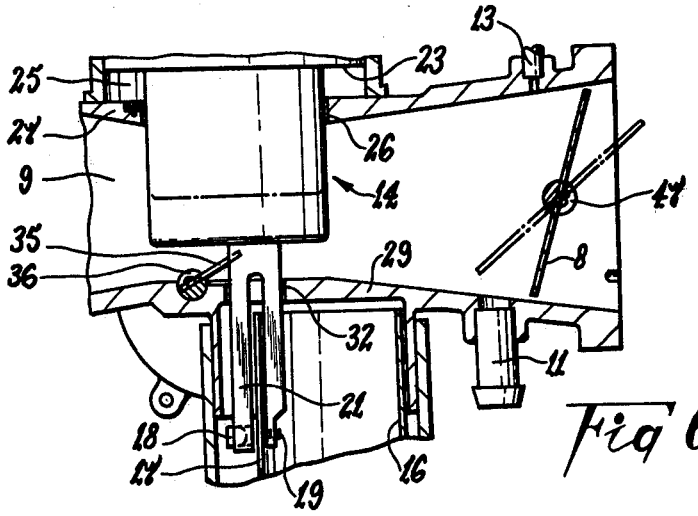

When the engine is cold, the coil 37 adopts a position such that the shaft 36 is rotated to project the control plates 35 into the duct 9, and such a condition is shown in FIG. 6. In FIG. 6(*a*), the piston extension 24 and the throttle valve 8 positions, are the positions at cold starting of the engine, and that particular position of the piston extension 24 is achieved because the plates 35 act as a minimum flow position stop for the piston extension 24. In that position of the piston extension 24, the axis of communication of the switching elements 18 and 19 will be located substantially as represented by line 41 in FIG. 5, so that the exposure width of the slit 17 is greater than if the plates 35 remained at the position shown in FIG. 2. Thus, at cold starting, the on-time of the injectors 3 is increased proportional to the level below normal engine temperature, through the influence of the coil 37 and plates 35, and a suitable enriched fuel-air mixture is achieved.

After the engine is started and is running under cold conditions, the increased air flow past the piston extension 24, through the restricted width, will cause the piston 23 to move further into the chamber 25 as previously described. The position of the piston extension 24 is different to what it would be when the engine is idling at normal temperature, because the plates 35 by their intrusion into the duct 9 from a secondary flow restrictor such that the air flow velocity past the piston extension 24 is increased. Consequently, the piston 23 is subjected to a greater pressure differential than would exist under normal running conditions, and the ratio of fuel delivered to air consumed is appropriately enriched by the resulting position of the switching elements 18 and 19. That is, under cold idling conditions, the communication axis of the elements 18 and 19 may be as shown by line 72 in FIG. 5, whereas when idling at normal temperature the communication axis may be positioned as represented by line 33 in FIG. 5.

As the throttle valve 8 is opened under cold running conditions, the increased air flow past the piston extension 24 will cause the piston 23 to move further into the chamber 25 as previously described. The relative positions of the piston extension 24 and throttle valve 8 are as shown in broken line in FIG. 6*b*. Similarly as for the cold idling condition, the plates 35, by their intrusion into the duct 9 causes the ratio of fuel injected to air consumed to be apporpriately increased. That is, under cold running conditions, the communication axis of the elements 18 and 19 may be as shown by line 42 in FIG. 5, where as for the same air flow rate to the engine at normal running temperature the communication axis may be positioned as represented by line 34 in FIG. 5. In that regard, the throttle position shown in broken line in FIG. 2 is the same as that shown in broken line in FIG. 6*b*.

The degree of intrusion of the tip of the flaps 35 into the duct 9, at a given cold engine temperature is determined by the need to achieve quick engine starting, but without excessive enrichment that would cause more exhaust emissions than necessary during this cold starting condition. The length of the flaps 35 and the characteristics of the bi-metallic spring 37 can be designed to achieve the necessary starting enrichment. Once the engine has been started, the degree of fuel enrichment depends on the lift of the flaps 35 and also on the width of the flaps 35. With the lift of the flaps 35 controlled by the cold starting requirement, the width of the flaps 35 is a parameter adjustable by design to achieve the necessary degree of mixture enrichment over the range of cold running conditions. In order to minimize exhaust emissions, the minimum width of flaps 35 consistent with acceptable engine performance during engine warming-up is employed.

Figure 3:
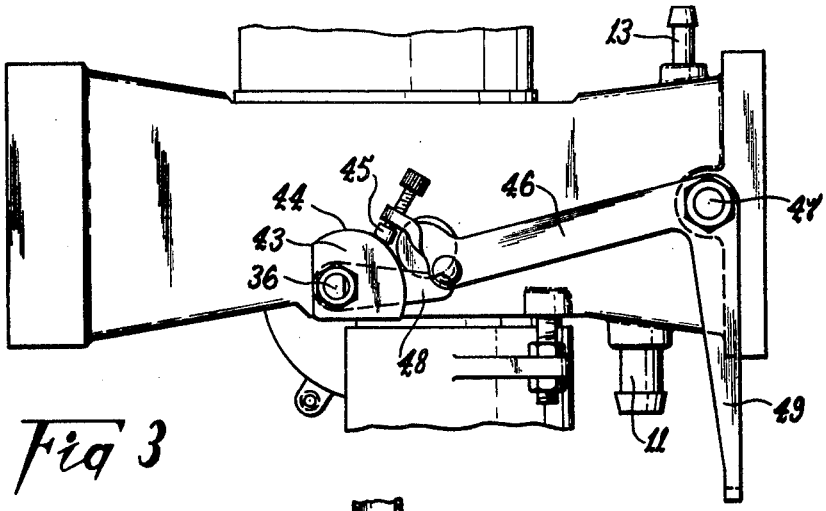
FIG. 3 is a side elevational view of the apparatus showing the relative positions of various external components under the conditions existing in FIG. 2.
Figure 7:
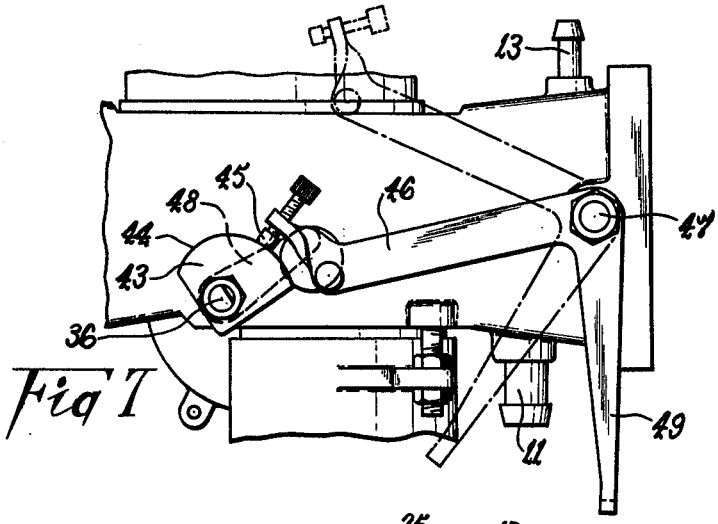
FIG. 7 is a view similar to FIG. 3 but showing the relative positions of external components under the conditions existing in FIG. 6(*b*)

It is a further feature of the particular construction shown, that the minimum flow position of the throttle valve 8 is also controlled by the heat responsive coil 37. That is preferably achieved by means of a cam plate 43 which is secured to the end of the shaft 36 remote from the coil 37 so as to be rotatable with that shaft, and which has a cam surface 44 engageable by an adjustable stop 45 of the throttle control lever 46. The lever 46 is connected to the plate of the throttle valve 8 through a rotatable shaft 47. When the engine is at the normal running temperature, the cam plate 43 will be positioned as shown in FIG. 3, and in that position the throttle valve 8 is held at a suitable idling position as shown in FIG. 2. During cold idling however, a larger quantity of the fuel-air mixture is required, and that is achieved by the cam plate 43 being positioned as shown in FIG. 7 by reason of the influence of the coil 37 on the rotational position of the shaft 36. In the FIG. 7 position, the control lever 46 has been moved clockwise from the position shown in FIG. 3 because of interaction between the stop 45 and the cam surface 44, and the throttle valve 8 is thereby opened (as shown in FIG. *6b*) beyond the position adopted in FIG. 2.

As the engine temperature increases from cold, the coil 37 will of course function to progressively move the shaft 36 towards the rotational position shown in FIG. 2. Consequently, there is progressive adjustment of the minimum flow positions of both the throttle valve 8 and the piston extension 24. There is also a progressive reduction of the enrichment of the fuel-air mixture caused by the influence of the control plates 35 on the position of the piston extension 24, during running of the engine.

Figure 8:
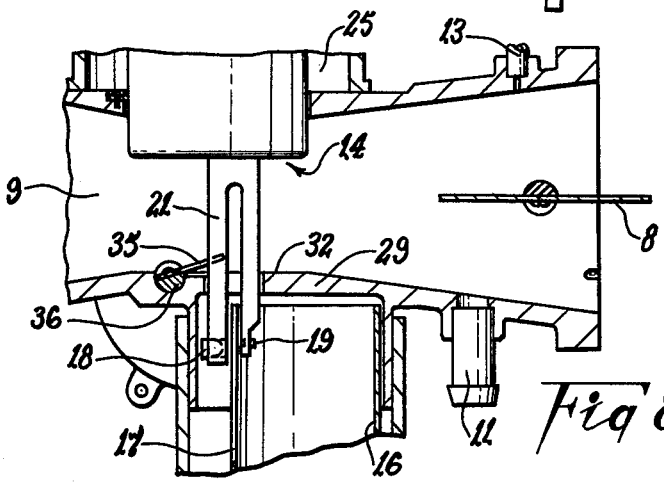
FIG. 8 is a view similar to FIG. 6(*b*) but showing the apparatus in the full throttle opening condition.
Figure 9:
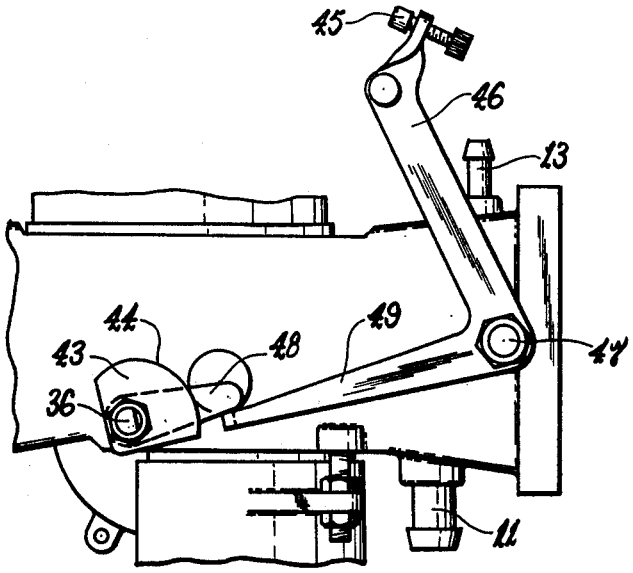
FIG. 9 shows the positions of the external components for the condition shown in FIG. 8.

Another feature of the preferred construction shown in the drawings, is the provision of means whereby the fuel-air mixture can be enriched at the maximum flow position of the throttle 8, which is the position shown in FIG. 8. One particular means whereby that result may be achieved is shown in FIG. 9, which represents the relative positions of the external components of the apparatus under the throttle valve condition existing in FIG. 8. In the arrangement shown, a striker 48 is secured to the shaft 36 at the same end as the cam plate 44 so as to rotate with that shaft, and a striker arm 49 is secured to the throttle shaft 47 to rotate with that particular shaft. The striker 48 and arm 49 are so arranged that they engage as the throttle valve 8 approaches the fully open position, with the result that continued opening movement of the throttle 8 causes the striker 48 to be swung anti-clockwise (as viewed in FIG. 9) thereby rotating the shaft 36 and causing the control plates 35 to intrude into the duct 9. That is, assuming the engine is at normal running temperature, since under cold running conditions the shaft 36 might already be in the position shown in FIG. 9, or even beyond that position, according to the temperature and influence of the coil 37.

As the plates 35 are projected into the duct 9 by the interaction of the arm 49 and striker 48, a secondary restriction to air flow results, and as previously described, the piston 23 is thereby caused to move further into the chamber 25. Thus, the position of the switching elements 18 and 19 is different to what it would be under normal full throttle conditions, and in particular those elements are located in a zone of greater width of the slit 17 so that the injector on-time is increased and there is appropriate enrichment of the fuel-air mixture.

It will be seen that the striker 48 is not restrained against movement beyond the position dictated by the arm 49. Consequently, under cold start conditions, if the throttle valve 8 is opened fully, the coil 37 may determine a position for the control plates 35 which is different to that shown in FIG. 9.

FIGS. 11 and 12 show an alternative embodiment of the apparatus, and the components of that embodiment which correspond in function to components of the previous embodiment, will be identified by the same reference numeral but in the series 100–199. The principal distinction of the embodiment of FIGS. 11 and 12, is that the switching means 115 is located remote from the remainder of the apparatus 104. Also, the rotatable interruptor 116 of the switching means 115 is a disc rather than a cup, and is driven by an extension 151 of the shaft of a distributor 152, although other drive arrangements may be employed. Movement of the flow monitor piston 123 is transferred to the switching elements 118 and 119 through a coupling, which in the construction shown includes a rigid rod 153 and a pivotally connected lever 154 which is mounted for rotation by way of a shaft 155. The carrier 121 for the elements 118 and 119, is secured to the shaft 115 so as to swing therewith, and in that way the elements 118 and 119 are positioned in the path of a suitable zone of the opening 117 of the disc 116.

As there is no need to pass the switching element carrier through the wall 129 of the duct 109, the control element can be a single plate 135 instead of two plates as previously described. Also, in the arrangement shown, positive pressure may be fed to the underside of piston 123 by a passage 130 which communicates direct with the interior of the duct 109.

It will be appreciated that the construction shown in FIGS. 11 and 12 functions as described in relation to the embodiment of FIGS. 1 and 2, and that the control plate 135 can be moved by temperature responsive means of the kind previously described. Still further, the previously described features relating to control of the throttle minimum flow position, and fuel enrichment at the throttle maximum flow position, can be incorporated in the embodiments of FIGS. 11 and 12.

Alternative to the rigid coupling described, that coupling may be electrical in nature, or it may employ a fluid connection. In the latter case, a fluid may be displaced in response to movement of the piston 123, and arranged to thereby cause appropriate movement of the carrier 121. That displacement may be as a result of direct influence by the piston 123, or indirect influence through a diaphragm or the like which responds to the movement of the piston 123. Such a fluid system may include temperature compensating means which compensates for volume changes in the fluid resulting from temperature changes, and such means may include a bi-metallic compensator. Still further, it will be understood that a rotatable cup rather than a disc may be used as the interruptor 116.

FIGS. 13 to 17 illustrate one particular means whereby temporary fuel enrichment may be achieved during sudden opening of the throttle valve. That feature may be applied to either of the embodiments described, but it will be convenient to describe it with particular reference to the embodiment described in relation to FIGS. 1 and 2. The desired temporary enrichment is achieved by a coupling 56 extending between the throttle control linkage 57 and the control element shaft 36, and that coupling 56 is arranged to yield under normal conditions of use, but is relatively rigid when force is suddenly applied through linkage 57. It is a further requirement that the coupling 56 will permit progressive restoration of the shaft 36 to the position it would have adopted but for its connection with the linkage 57 through the coupling 56.

The particular coupling 56 shown, includes a cylinder 58 which contains a fluid 59 and a piston 61 slidably mounted in the cylinder 58. The piston 61 is provided with a bleed passage 62 whereby fluid 59 can be displaced from one side of the piston 61 to the other, and piston 61 is connected to linkage 57 through a rod 63 projecting through one end of the cylinder 58, and a pin 64 connecting the terminal end of the rod 63 to the linkage 57. A pivotal connection 65 is provided between the end of the cylinder 58 remote from the pin 64 and the striker 48 secured to the shaft 36. It will be appreciated however, that the connection 65 could be with a member separate from the striker 48 but which is also secured to the shaft 36 so as to rotate therewith.

The size of the bleed passage 62 is predetermined according to the viscosity of the fluid 59 and the desired maximum rate of transfer of the fluid 59 from one side of the piston 61 to the other. In particular, it is desirable that under normal progressive opening of the throttle 8 through movement of the linkage 57, the rate of bleed through the passage 62 will be sufficient to permit the piston 61 to move relative to the cylinder 58 which is held substantially stationary by its connection with the shaft 36. The shaft 36 is in turn held against rotation by the action of the coil 37, in resistance to the forces occurring within the cylinder 58 by virtue of the inherent resistance to extension of the coupling 56. That is, the coil 37, although flexible, applies a restraining force on the shaft 36 which is of sufficient magnitude to resist the turning force imposed by action of the coupling 56 on the striker 48.

FIGS. 13 and 14 show the condition of the coupling 56 and the position of linkage 57, when the throttle 8 is at the minimum flow position as shown in FIG. 2 and the control element shaft 36 is at the rest position in which the plates 35 do not intrude into the duct 9 (also shown in FIG. 2). When there is sudden movement of the linkage 57 in the throttle opening direction to the position shown in FIG. 15, there will not be sufficient time for the fluid 59 to escape through the passage 62 so that the piston 61 and cylinder 58 move as a single body with the linkage 57 to the new position shown in FIG. 15. There will of course be a range of speeds of movement of the linkage 57 between normal and what is termed sudden, during which there will be some relative movement between piston 61 and cylinder 58 because of partial bleed through the passage 62.

Figure 15:
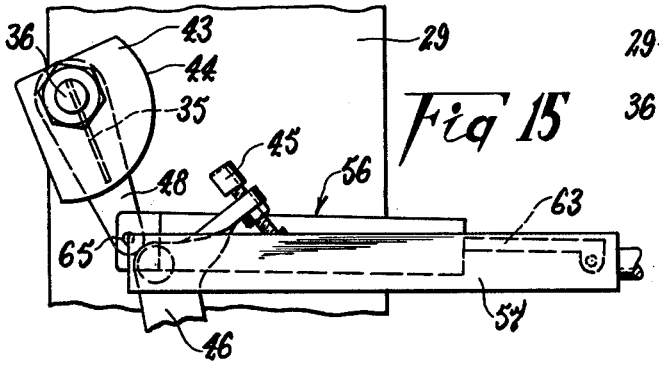
FIG. 15 is a view similar to FIG. 13 but showing the throttle linkage in a different position of operation.
Figure 16:
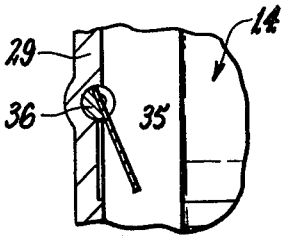
FIG. 16 is a cross-sectional view showing the condition of the control element under the condition shown in FIG. 15.

Movement of the cylinder 58 with the piston 61 to the position shown in FIG. 15, naturally causes rotation of the shaft 36 through the connection with the striker 48, so that the plates 35 are projected into the duct 9 as shown in FIG. 16. As a result there is a secondary restriction influence on the piston 23 as previously described, with consequent enrichment of the fuel-air mixture. Assuming the engine is at normal running temperature and the throttle 8 is not fully opened, such enrichment is required only for so long as is necessary for the engine to adjust to the sudden change of throttle condition. Consequently, a bias is preferably applied to the coupling 56 so that it will naturally tend to return to the rest position as existing in FIGS. 13 and 14. That bias can be effected in many ways, but is preferably effected through the coil 37 which has inherent resilience and is already connected to influence the position of the shaft 36.

Figure 17:
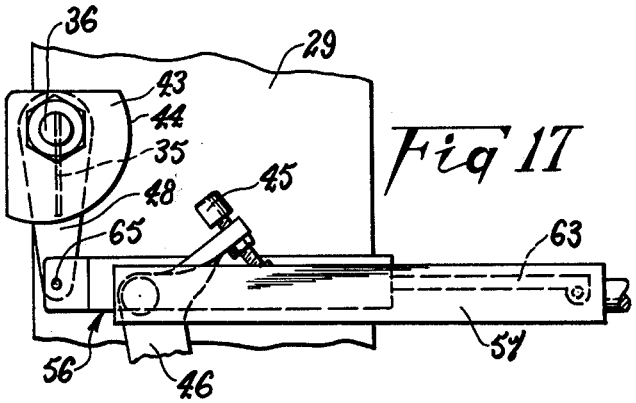
FIG. 17 is a view similar to FIG. 15 but showing a subsequent condition of the throttle linkage coupling.

Thus, when the linkage 57 is brought to rest, the coil 37 functions to turn the shaft 36 in a direction such that the cylinder 58 is progressively pulled back relative to the piston 61, at a rate determined by the restoring force of the coil 37, and/or the permissible rate of bleed through the passage 62. The eventual relative positions of the linkage 57 and coupling 56 may be as shown in FIG. 17, in which the shaft 36 is back in the rest position and the plates 35 do not intrude into the duct 9 so that the normal fuel-air mixture is supplied to the engine. It will be understood that the condition shown in FIG. 17 will also exist if the linkage 57 is moved at normal speed from the FIG. 13 position to the FIG. 17 position, so that there is no movement of the cylinder 58 between the conditions shown in FIGS. 13 and 17 respectively.

Obviously, the coil 37 may either expand or contract upon heating, according to how it is arranged, and if it is expanded when heated it is preferred that the resilient distortion occurring between the FIG. 13 and 15 conditions, is in the nature of contraction.

The apparatus and system of the present invention provides a simple, economical and convenient means for automatically increasing both the ratio of injected fuel to air consumed and the mass flow of air under conditions of cold engine start and running. Moreover, the apparatus and system permits that ratio and mass air flow be progressively adjusted to the optimum fuel to air ratio as engine temperature rises, thereby minimizing the risk of undue emission of exhaust pollutants such as can result from delayed adjustment of a manual enrichment device.

Moreover, the invention permits a desirable enrichment effect that is most significant under starting conditions such that, at any temperature, the degree of richness is reduced as the air consumption increases in a manner that is variable by design and offers minimal or no restriction to air flow into the engine when the engine is warmed to normal operating temperature.

In one form the invention may employ a variable output of a thermostatic element already present in an engine for allowing extra idle air into the engine under cold engine operating conditions.

As indicated, these advantages are achieved by utilizing the output of a temperature responsive means, such as a thermostatic element, to provide an increased fuel to air ratio during cold starting and running. That is, the output of the temperature responsive means is coupled to a movable control element provided in a variable venturi device. Under cold stopped engine conditions that thermo-statically controlled element bears on a flow responsive member and moves that member in the direction indicating increased flow. Further, when the engine is operating and consuming air but still not warmed to operate properly, this same element causes a partial obstruction of the normal variable area flow passage so that the movement of the flow responsive member is greater than would be obtained were the engine fully warmed and the thermo-statically controlled element fully retracted. The degree of obstruction for a given movement into the air stream can be designed so as to give the required enrichment characteristic.

It will be appreciated that modifications may be made to the present invention without departing from its spirit or scope. For example, the temperature responsive means may incorporate temperature sensing means other than a bi-metallic coil; for example it may utilize expansion of fluid to generate an output for effecting adjustment of the movable control element of the device. Additionally, adjustment of the stop controlling the minimum flow position of the throttle valve may for example be effected directly by such fluid or bi-metallic element rather than through the output member of the latter; while position sensing means of forms other than the levers described may be used.

Further, means for supplementary electric heating may be provided for heating the temperature responsive means at a faster rate than the increased engine temperature as indicated by exhaust gases or engine coolant to provide a quick closing-off effect. This, it will be appreciated, will result in more rapid adjustment of the optimum fuel to air ratio necessary for normal engine operation.

Still further, location of the switching means remote from the flow member, avoids the need for an intermediate drive connection such as is necessitated if the switching means is to be in close proximity to the flow monitor. The complexity of the coupling system required in the remote location arrangement, will generally vary with the spacing and relative orientation of the flow monitor and the switching elements, and whether the switching means is to be driven from the distributor shaft, cam shaft or crank shaft.

Such a coupling system, in eliminating the need for a special rotary drive mechanism between the engine and the fuel injection proportioning system, permits a significant reduction in the cost and difficulty of application of such fuel injection systems. It will be appreciated that variation from and modification of the forms of the connecting system described are possible without departing from the spirit or scope of the present invention.

Having now described my invention, what I claim as new and desire to secure by Letters Patent is:

1. Fuel feed control apparatus for internal combustion engine fuel injection systems, including:

a duct having an air flow passage formed therethrough and being connectable into the air induction system of an engine;

an air flow monitor connected to said duct and being responsive to flow of air through said passage to move relative to said duct along an axis transverse to said flow, and being connectable to switching means for at least one injector of said injection system to determine the on time of the injector according to the position of said monitor relative to said duct;

an enrichment control member mounted for movement through a range of operative positions in which it intrudes into said passage so as to modify air flow characteristics through said passage, the degree of said intrusion and consequently said modification varying between a maximum at an extreme operative position and substantially zero at an inoperative position of said enrichment control member;

a portion of said enrichment control member being engageable with said monitor so that said enrichment control member is operable during movement towards said extreme operative position, to move said monitor into a position such as to influence the fuel enrichment characteristics of said apparatus, the degree of said maximum intrusion of said enrichment control member being predetermined so that said monitor is displaced thereby to produce enrichment characteristics for engine cold starting conditions, and said enrichment control member being further operable in at least some of said operative positions to provide a variable position stop which determines a minimum displacement of said monitor;

said enrichment control member being contoured so that, when said member and monitor engage, an opening is provided to permit air flow through said opening, thereby ensuring that no displacement of said monitor due to air flow results until said air flow exceeds a predetermined minimum, the nature of said opening being predetermined to produce suitable enrichment characteristics over a range of engine operating conditions, and said enrichment characteristics varying with variation of said air flow modification; and temperature responsive means connected to said enrichment control member to cause said movement thereof, and being connectable to the engine so as to respond to the temperature thereof and thereby vary the position of said enrichment control member.

2. Apparatus according to claim 1, wherein said monitor intrudes into said duct and is movable relative to the walls thereof.

3. Apparatus according to claim 2, wherein said control member includes a plate which is pivotally connected to a wall of said duct so as to be movable between an inoperative position in which it makes substantially no intrusion into said air duct, and a maximum intrusion position in which it extends substantially transverse to the axis of said duct.

4. Apparatus according to claim 3, wherein said control plate member further includes a shaft which is rotatable relative to said duct and which extends substantially transverse to said duct axis, said plate being secured to said shaft, and said temperature responsive means is connected to said shaft to cause rotation thereof.

5. Apparatus according to claim 1 wherein a throttle valve is connected to said duct on the air outlet side of said control member, said throttle valve being operable to restrict flow of air through said duct and being adjustable to vary the degree of that restriction, and stop means is connected to said temperature responsive means to be moved thereby and being arranged to determine a maximum restriction position of said throttle valve, which position varies according to engine temperature.

6. Apparatus according to claim 1, wherein a chamber is connected to said duct, said monitor includes a piston slidably mounted in said chamber and arranged to intrude into said duct passage, a communication passage is formed through the end of said piston to provide communication between said chamber and said duct passage, and said control member is positioned relative to said piston so that the region of maximum intrusion of said control member is located relatively close to said communication passage.

7. A control system for internal combustion engine fuel injection systems, including:

an air supply passage connectable to at least one cylinder of the engine and the outlet of the fuel injector associated with said cylinder;

a throttle valve operable to restrict the flow of air through said passage and being adjustable to vary the degree of that restriction;

injector switching means operable to cause intermittent actuation of said injector and to determine the period of time over which each said actuation extends;

an air flow monitor connected to said passage on the air inlet side of said throttle valve and being movable in response to flow of air through the passage;

means connecting said flow monitor and said switching means whereby said period of time is varied according to the flow of air through said passage;

an enrichment control member mounted for movement through a range of operative positions in which it intrudes into said passage so as to modify air flow characteristics through said passage, the degree of said intrusion and consequently said modification varying between a maximum at an extreme operative position and substantially zero at an inoperative position of said enrichment control member;

a portion of said enrichment control member being engageable with said monitor so that said enrichment control member is operable during movement towards said extreme operative position, to move said monitor into a position such as to influence the fuel enrichment characteristics of said apparatus, and said enrichment control member being further operable in at least some of said operative positions to provide a variable position stop which determines a minimum displacement of said monitor;

said enrichment control member being contoured so that, when said member and monitor engage, an opening is provided to permit air flow through said opening; and movement means connected to said enrichment control member to cause said movement thereof.

8. A control system according to claim 7 wherein said movement means comprises temperature responsive means, said temperature responsive means being connectable to the engine so as to respond to the temperature thereof and thereby vary the position of said enrichment control member.

9. A control system according to claim 8, including a linkage system through which said throttle valve is operated, a yiedable coupling connecting said control member to part of said linkage system, said coupling means being arranged to respond to sudden movement of said linkage system part in a throttle opening direction to cause said control member to intrude into said passage, said coupling yielding under gradual movement of said linkage part in said opening direction to cause little or no movement of said control member.

10. A control system according to claim 9, wherein said temperature responsive means resiliently resists movement of said control member into said passage under the influence of said coupling, and when said control member has been so moved functions to cause said coupling to progressively yield and thereby restore said control member to a position as determined by said temperature responsive means.

11. A control system according to claim 9, wherein said coupling includes an extendable and retractable pistoncylinder assembly, a fluid contained within said cylinder, and bleed means associated with said piston and arranged to permit said fluid to be displaced from one side of said piston to the other at a controlled rate.

12. A control system according to claim 7, further including a chamber connected to a wall of said passage, said chamber projecting outwardly therefrom, and an opening in said passage wall for providing communication between said chamber and passage, and wherein said monitor comprises a piston slidably mounted in said chamber, a portion of said piston extending through said wall opening so as to intrude into said passage, and further including biasing means for urging said piston towards the opposite wall of said passage.

13. A control system according to claim 12, wherein communication means is provided such that the flow of air through said passage creates a negative pressure in said chamber, the magnitude of which increases with increase in the velocity of said air flow, and said piston is caused to move further into said chamber against said biasing means by the resulting pressure differential occurring between said chamber and said passage.

14. A control system according to claim 7, wherein said switching means includes a rotatable member having a slit of varying width formed through a portion thereof, a carrier, a light source and a light detector mounted on said carrier in spaced opposed relationship and located on opposite sides respectively of said rotatable member portion, said detector being responsive to light received from said light source to generate an electrical signal which functions to operate said injector, and said carrier is responsive to movement of said monitor to move said carrier relative to said slit containing portion such that there is a variation in the width of said slit through which said detector and said light source are exposed during each rotation to said rotatable member.

15. A control system according to claim 7, including a linkage system through which said throttle valve is operated, and wherein a striker member is connected to said control member to move therewith and is arranged for cooperation with part of said linkage system, whereby said control member is caused to intrude into said passage during a final stage of movement of said throttle valve into its minimum restriction position.

16. A control system according to claim 7, wherein said switching means is located remote from said monitor and is connected thereto through coupling means.

17. A control system according to claim 7, wherein said switching means and said monitor are located on opposite sides respectively of said passage, and said control member is located at that side of said passage adjacent said switching means.

* * * * *